United States Patent [19]

Matthews

[11] 4,150,632

[45] Apr. 24, 1979

[54] CHAR SEPARATOR

[75] Inventor: Francis T. Matthews, Poquonock, Conn.

[73] Assignee: Combustion Engineering, Inc., Windsor, Conn.

[21] Appl. No.: 847,862

[22] Filed: Nov. 2, 1977

[51] Int. Cl.[2] ..... F23B 1/00

[52] U.S. Cl. ..... 110/342; 122/4 D; 209/135; 110/219

[58] Field of Search ..... 110/342–344, 110/245, 263, 266, 224, 229, 218, 219, 220; 122/4 D; 209/138; 432/15, 58

[56] References Cited

U.S. PATENT DOCUMENTS

| | | | |
|---|---|---|---|
| 2,978,103 | 4/1961 | Cowher, Sr. | 209/135 R |
| 3,123,551 | 3/1964 | Walker | 209/135 R |
| 3,508,506 | 4/1970 | Bishop | 122/4 D |
| 3,599,610 | 8/1971 | Spector | 110/209 |
| 3,902,462 | 9/1975 | Bryers | 122/4 D |
| 3,905,336 | 9/1975 | Gamble et al. | 122/4 D |
| 3,966,431 | 6/1976 | Craig et al. | 122/4 D |

*Primary Examiner*—Henry C. Yuen

*Attorney, Agent, or Firm*—Joseph H. Born; Richard H. Berneike

[57] ABSTRACT

Particulates removed from the flue gases produced in a fluidized-bed furnace are separated into high-and low-density portions. The low-density portion is predominantly char, and it is returned to the furnace or burned in a separate carbon burnup cell. The high-density portion, which is predominantly limestone products and ash, is discarded or reprocessed.

According to another version, the material drained from the bed is separated, the resulting high-and low-density portions being treated in a manner similar to that in which the flue-gas particulates are treated.

26 Claims, 5 Drawing Figures

CHAR SEPARATOR

BACKGROUND OF THE INVENTION

Due to increasing concern about the effects of certain pollutants that result from coal burning, alternate methods for burning coal are being investigated. One of the methods that is employed to reduce the production of oxides of sulfur uses a fluidized bed, in which the force of the flowing combustion air is used to keep coal particles in a quasi-liquid state. Limestone particles are included in the bed, and the heat of combustion causes the limestone to give off some carbon dioxide, forming quicklime. Quicklime reacts with sulfur trioxide or oxygen and sulfur dioxide to produce a calcium sulfate coating on the limestone. The sulfur content of the stack emissions is thereby reduced.

The operation of the fluidized bed has certain drawbacks, one in particular being the amount of dust loading of the flue gas, which is one or two orders of magnitude greater than that which characterizes conventional pulverized coal-firing. This dust loading necessitates incorporating large centrifugal separators, and baghouses to reduce plant particulate emission to or below EPA limits. The high dust loading greatly increases the wear experienced by equipment such as superheater and reheater tubes, air heaters, and so on. In addition, part of the dust is unburned fuel having heating value, so efficiency is lost unless the dust is reclaimed. But the recycling of the dust necessitates that large ducts be provided to transport the dust around the system, and this increases capital expenditures.

SUMMARY OF THE INVENTION

Accordingly, the present invention is a method and apparatus for operating a fluidized-bed furnace so as to reduce the wear and capital expenditure resulting from dust loading.

According to the present invention, a fluidized-bed furnace is connected to feed its gaseous combustion products to means for removing the particulates entrained therein. A means is provided for receiving the particulates from the particulate-removal means and separating the particulates into portions of relatively high and low density. A char-burning furnace is connected to the separation means to receive the portion of relatively low density and burn it.

According to a refinement of the invention, the separation means includes a perforated table having first and second ends. Also included are means for receiving particulates from the removal means and depositing them on the upper surface of the perforated table at the first end, thereby allowing them to migrate to the second end. Means are provided for causing a stream of air to flow through the perforated table from its lower surface to its upper surface, the stream being sufficiently strong above the first end to fluidize substantially all the particulates occupying the table at the first end, the strength being gradually reduced toward the second end to the extent that substantially all particulates above a predetermined density are no longer fluidized at the second end, the particulates thereby being stratified during migration from the first end to the second end, the denser particles lying on the table below particles of lower density. A scoop is positioned at the second end of the table at such a height as to remove only those particles that are more than a predetermined height above the table at the second end, and means are provided for feeding the particulates removed by the scoop to a char-burning furnace.

In an alternate version of the present invention, a means is provided for removing from the bed a part of the mixture contained therein. The separation means in this version acts on the removed portion, and the low-density portion is sent as before to a char-burning furnace for combustion. In either version, the char-burning furnace can be either a separate carbon burnup cell or the main fluidized-bed furnace itself.

BRIEF DESCRIPTION OF THE DRAWINGS

These and further features and advantages of the present invention can be understood by reference to the preferred embodiments shown in the attached drawings, in which.

DETAILED DESCRIPTION OF THE PREFERRED EMBODIMENTS

Figure 1:
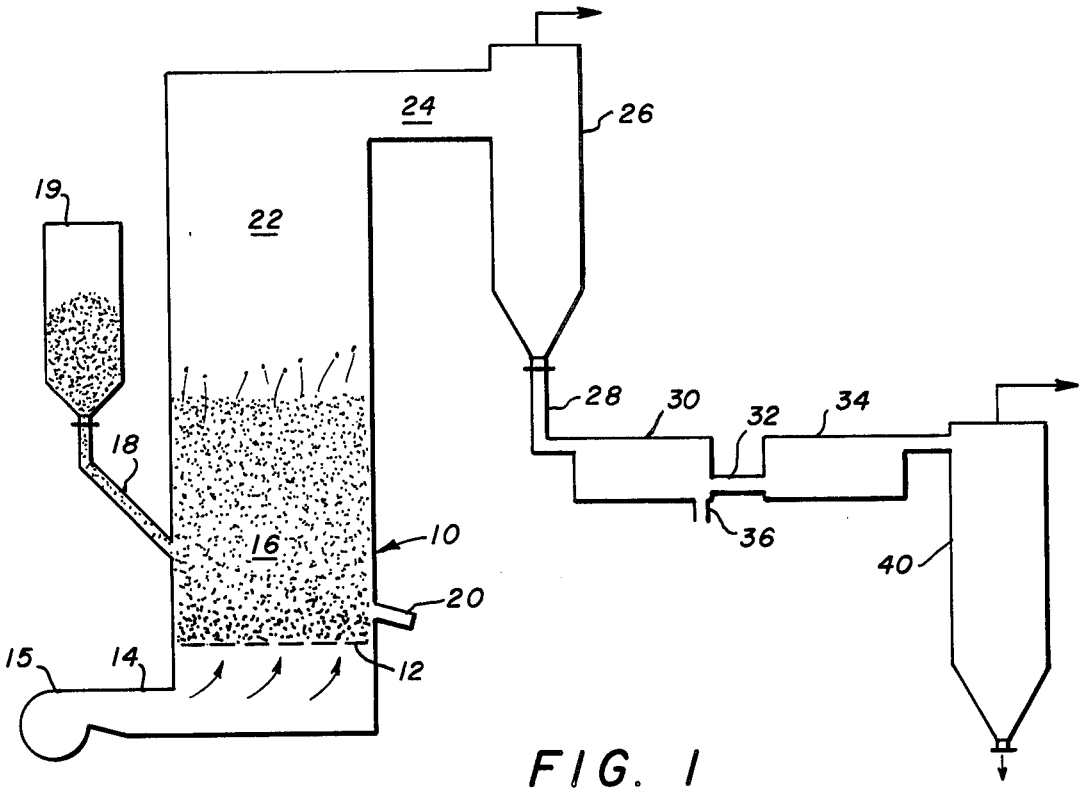
FIG. 1 is a diagram of a furnace system arranged according to the present invention.

FIG. 1 depicts a fluidized-bed furnace system designed according to the teachings of the present invention. A furnace, indicated generally at 10, has a grate 12 in its lower portion. The grate has holes in it through which air can pass but most particles cannot. An air conduit 14 is connected to a fan 15 to blow air into the furnace 10 below the grate 12. The air entering the furnace 10 through the air conduit 14 flows up through the grate 12 to fluidize particles occupying the furnace in the bed 16 above the grate 12 and also to provide oxygen for combustion. The bed is kept filled by a fuel conduit 18 that conducts a mixture, typically of limestone and coal, from a hopper 19 into the bed 16. The combustion occurs in the bed 16, in which limestone and a carbonaceous material such as coal or wood chips is kept in a fluidized state. If the fuel is coal, it is typically supplied in particles on the order of a quarter inch in diameter, and the fluidization results in a quasi-liquid mass having a more or less definite upper boundary. If the coal contains sulfur, sulfur oxide gases are produced as the coal burns, but the calcined limestone particles in the bed react with the sulfur oxides and the oxygen left over after combustion, and so the sulfur oxides are thereby removed.

In the process, the limestone particles are coated with calcium sulfate and are thereby deactivated. (Strictly speaking, it is not limestone that is coated with calcium sulfate, because a limestone particle must be at least partially calcined to react with the sulfur oxide. For simplicity, however, these particles will be referred to as limestone.) A drain 20 is provided in the bed for removing some of the mixture, thus removing some of the deactivated limestone particles. As may be appreciated, some limestone particles that are not yet deactivated, as well as some unburned fuel, is also removed by the drain. Statistically, however, the material leaving by way of the drain contains more deactivated limestone particles and less unburned fuel than the mixture entering through the fuel conduit 20, so the bed composition is being continuously refreshed. The drained material may be discarded or sent to some kind of reclaiming operation.

Though, as was mentioned before, the bed 16 has a more or less definite upper boundary, particles are continuously ejected from the bed due to the action of gas bubbles passing through the bed. For this reason, a freeboard area 22 is provided above the bed; particles of some minimum intended size and density that are thrown out of the bed describe their entire trajectories within the freeboard are a 22, thereby falling back into the bed 16. Particles of smaller size and/or lower density are carried out of the freeboard by the combustion-product gases.

Above the freeboard area, the furnace opens into an outlet duct 24. Various heat-transfer devices would normally occupy this area, but they have been left out of FIG. 1 for the sake of simplicity. The outlet duct 24 feeds a separator assembly 26, which typically contains a group of centrifugal separators for removing particulates from the combustion-product gases that are produced by the furnace. The particulates leave the bottom of the separator assembly through a conduit 28. According to the present invention, this conduit connects the separator assembly 26 with a fluidizing separator 30, described in greater detail below, for separating the particulates into portions of relatively high and relatively low density. The lower-density portion, which is mainly char, or unburned carbon, passes through an appropriate transfer line 32 that connects the fluidizing separator 30 with a carbon burnup cell 34. An inerts outlet line 36 removes the higher-density material from the fluidizing separator 30 for reclamation or disposal. The higher-density material consists chiefly of limestone particles and ash.

The carbon burnup cell 34 is a fluidized-bed furnace in the preferred embodiments, though there is no reason, in principle, why a different type of furnace could not be substituted. Its operation can therefore be understood by referring to the discussion of the other fluidized-bed furnace 10. The basic difference between the carbon burnup cell 34 and the main furnace 10 is that, since no limestone is added to the bed in the carbon burnup cell 34, no drain is provided. As with the other fluidized-bed furnace, an outlet duct 38 is provided that leads to a centrifugal-separator assembly 40. In this case, however, the particulate output of the separator assembly 40 would typically be discarded. It would be typical for the gas outlets of both separator assemblies to feed further cleaning apparatus not shown in the drawings.

Figure 2:
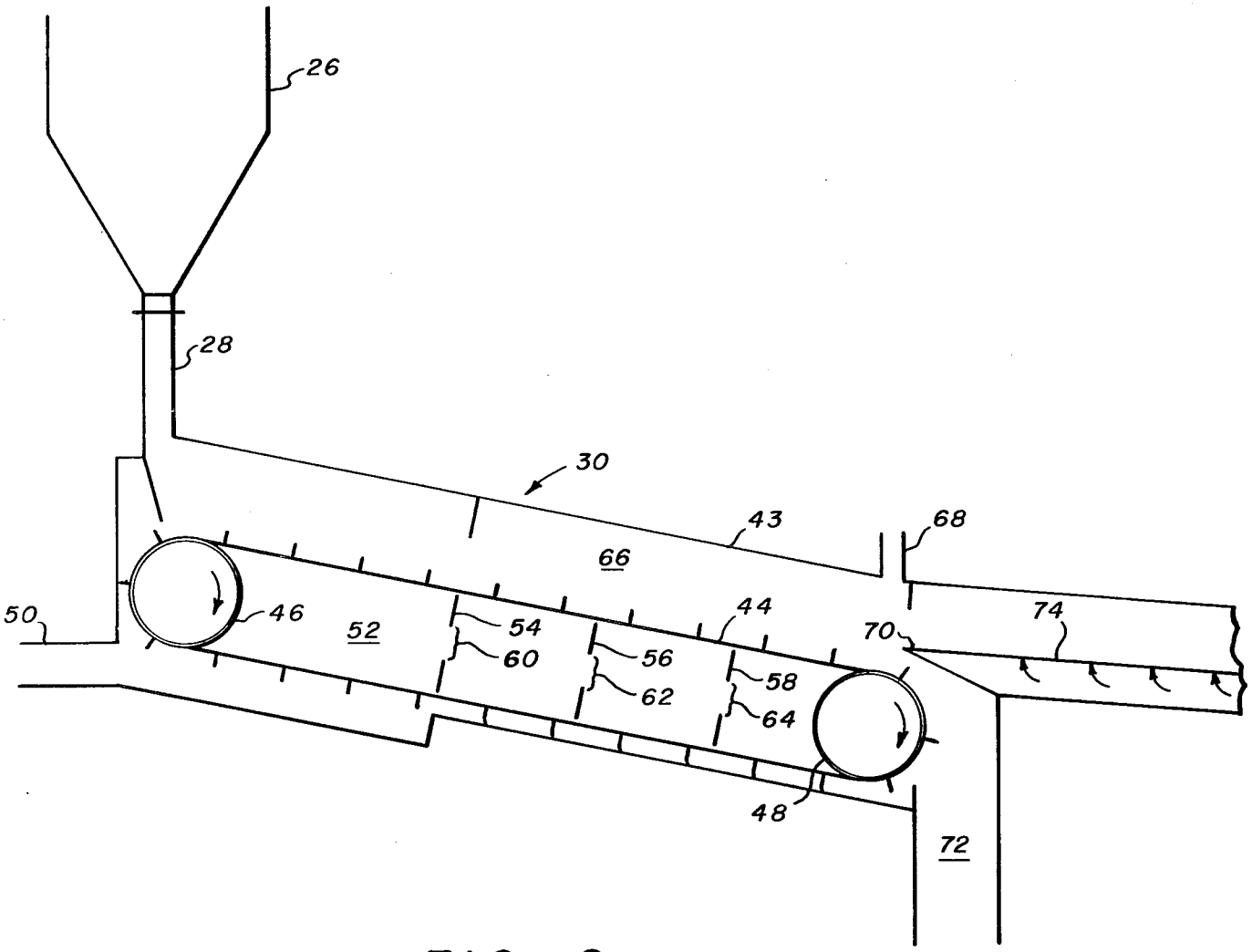
FIG. 2 is a more detailed diagram of the separator 30 of FIG. 1.

FIG. 2 diagrammatically shows the operation of the fluidizing separator 30 in FIG. 1, to which the centrifugal-separator assembly 26 is connected through a conduit 28. The separator 30 comprises a housing 43, inside which a perforated endless belt 44 is mounted on two rollers 46 and 48, the left one 46 being located higher than the right one 48. Depending on particle size, the perforated belt could be made of screen, porous fabric, or anything else that would permit the passage of gas but not of particles. The part of the belt 44 that is stretched between the upper surfaces of the rollers 46 and 48 forms a table inclind from left to right. A gas inlet 50 supplies a gas to the space 52 defined by the inner surface of the belt 44. Though the gas supplied could be air, it is thought that it would be desirable in most cases to supply flue gas or some other gas that would not support combustion.

The vertical walls of the housing 43, which are not shown in FIG. 2, support plates 54, 56 and 58, which are mounted in space 52 and penetrated by orifices 60, 62 and 64. The gas is supplied from the sides in the space between the leftmost plate 54 and the left roller 46. To the right of the leftmost plate 54, the belt is mated to the vertical walls of the housing 43, and the bottom wall of the housing 43 forms a labyrinth seal with flexible ribs spaced along the belt 44. Thus, gas introduced into the space 52 interior to the belt must flow through the perforations in its upper surface, into the particle space 66 between the upper belt surface and the roof of the housing, and out an appropriate vent 68 in the roof of the housing. Because of the flow resistance offered by the plates 54, 56 and 58, the rate of gas flow through the belt 44 is greatest at the left end of the belt 44, and it fluidizes essentially all of the particles deposited on the belt 44. The fluidization gradually decreases toward the right end, where the fluidization is minimal. It is thought that optimum performance will result from a relatively short residence time in the highest-velocity region, and a gas velocity at the left end that equals or only slightly exceeds the fluidizing velocity of the heavy particles.

A scoop 70 mounted above the right roller 48 has a wedge-shaped edge oriented parallel to the belt 44 at a predetermined distance above it. The scoop skims off particles that are more than the predetermined distance above the belt 44. The edge of the right roller 48 feeds a chute 72 arranged to receive the particulates that are not skimmed off by scoop 70. The chute 72 is part of the inerts outlet line 36 and feeds whatever means may be supplied for dealing with limestone and ash, which are the major constituents of the material handled by the chute 72. The particulates that are skimmed off by scoop 70 are delivered by an appropriate transfer line, such as air slide 74, to the carbon burnup cell. Again, it may be preferred to use a gas other than air in the "air" slide 74. In the alternative, an ordinary belt could be used instead of the air slide 74.

During operation of the furnace, the violent activity in the bed results in attrition, the term used in the art to refer to the reduction in size of both limestone and coal particles due to grinding and collisions. Smaller particles are also produced by decrepitation; the heat in the bed causes evolution of carbon dioxide from the limestone and the resulting carbon dioxide pressure causes some limestone particles to break up from within. Because of attrition and decrepitation, many particles are small enough to be carried by the gases that flow through the freeboard 22 and leave by way of the outlet duct 24. Since much of this particulate matter is char, which has heating value that it is desirable to recover, the particulates are removed from the combustion-product gases by the separator assembly 26 and sent to the carbon burnup cell 34 for reuse.

According to the present invention, only a part of the particulates is sent to the carbon burnup cell 34. Before particulates are fed to the carbon burnup cell 34, they are sent to the fluidizing separator 30 for segregation between char and other components. The char is deposited on the left end of the belt 44, where the gas flowing through the perforated table causes fluidization of almost all of the particles. The particles move to the right, partly by the action of the belt and partly by the action of gravity, and as they move to the right, the degree of fluidization decreases. As a result, the dense particles begin to settle to the surface of the belt, while the less dense particles remain in a fluidized state. By the time the end of the belt is reached, the least dense particles, which were the last to defluidize, settle onto the top of the pile. The particulates are predominantly char, limestone and ash, and since char is several times less dense than the other constituents of the mixture, it is the last to defluidize. Accordingly, when the particulates reach the scoop 70, most of the particulates skimmed off by the scoop 70 are char, while most of what falls down the chute 72 is limestone, ash and other waste.

The fluidizing separator 30 is referred to as a means for separating particulates according to density. This characteristic of the separator is emphasized because density is the relied-on difference between char particles and limestone or ash particles; any means for separating according to density could therefore be substituted. It is to be noted, however, that a fluidizing separator also has a tendency to classify according to size, that is, there would be a correlation not only between the height of a particle at the right side of the bed and its density but also between that height and particle size. Thus, some particles of low density could have a tendency to defluidize early if they were large enough, while some very small particles could defluidize later despite their high densities. However, due to the large density difference between the char particles and the other particles, classification according to density can be expected to predominate, thus resulting in a good separation of char from other matter.

The char separated out by the fluidizing separator 30 follows a transfer line 32 to the carbon burnup cell 34. As was noted before, the carbon burnup cell only receives fuel (predominantly char), and no limestone is added. Accordingly, no drain is provided. Another difference between the carbon burnup cell and the main furnace is that the carbon burnup cell is maintained at a higher temperature, around 2000° F. (1100° C.) whereas the main furnace runs at around 1550° F. (840° C.). This is because the temperature in the main furnace is set to optimize the removal of sulfur from the combustion gases, whereas the temperature in the carbon burnup cell is set for enhanced carbon combustion. As a result of the temperature in the carbon burnup cell, rather complete carbon combustion is effected. Consequently, what little carbon is removed by the separator assembly 40 is discarded.

Figure 3:
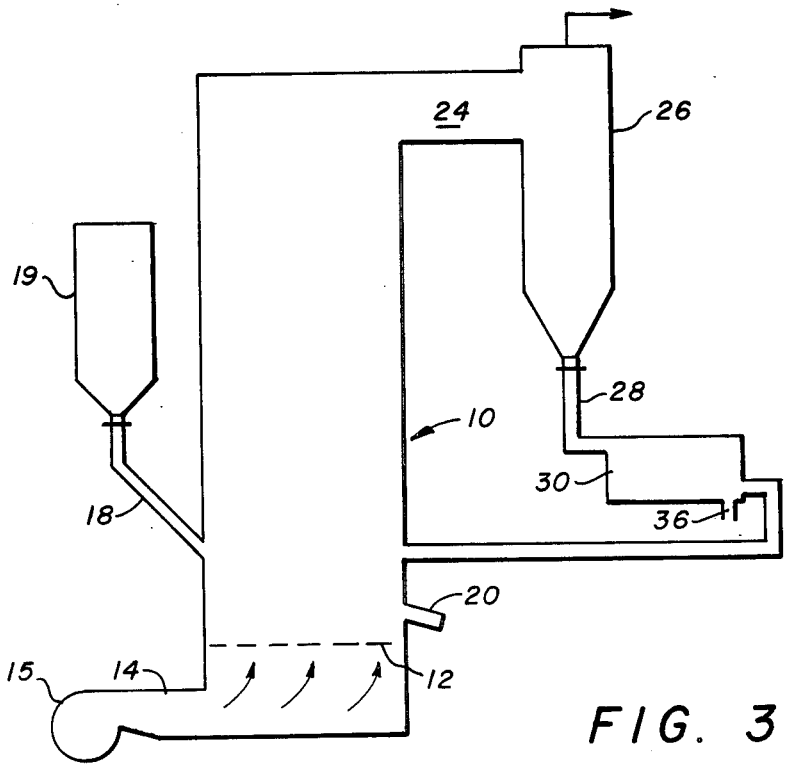
FIG. 3 is a diagram of another embodiment of the present invention.

The FIG. 1 embodiment of the present invention is principally intended for use in utility applications, in which large furnaces are employed for the production of electricity. Provision of a carbon burnup cell requires a significant commitment of capital, of course, but the efficiencies it affords justify its use in utility units. In industrial units, on the other hand, the provision of a carbon burnup cell may not always be justified, and in such units the particulates would merely be returned to the main furnace. The arrangement of such a unit to employ the present invention is shown in FIG. 3, the elements having the same numbers as corresponding elements in FIG. 1. The operation is as was described in connection with FIGS. 1 and 2, the only difference being that the output of the fluidizing separator 30 is returned to the main furnace 10 and not sent to a carbon burnup cell.

Figure 4:
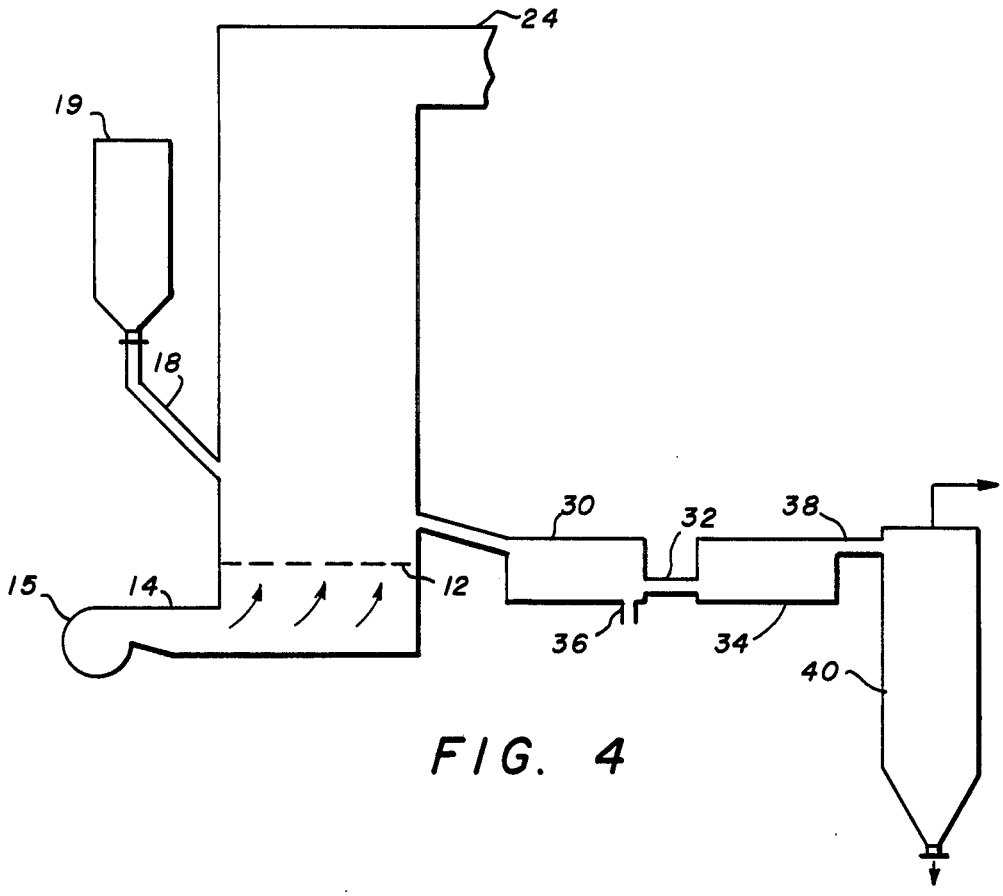
FIG. 4 is a diagram of another embodiment of the present invention.
Figure 5:
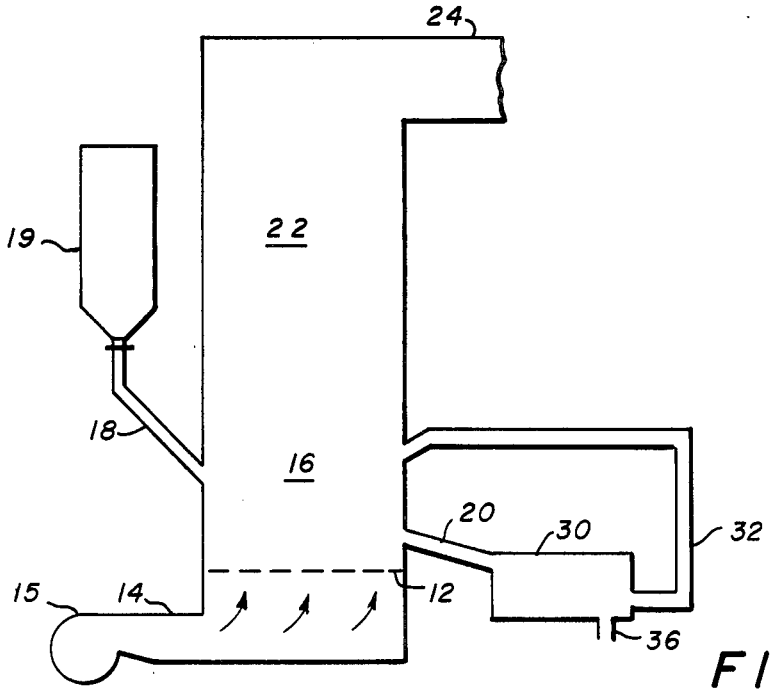
FIG. 5 is a diagram of still another embodiment of the present invention.

The principle of the present invention can also be employed to reclaim the fuel that leaves the furnace 10 by means of the drain 20. The purpose would be to separate the unburned char in the bed drain output, which can be used immediately, from the ash and limestone, which must be reactivated or discarded. As in the other embodiments, the separated char would go either to the carbon burnup cell or back to the bed. FIGS. 4 and 5 are diagrams of units in which the char is separated from the drain output.

Through the use of the present invention, substantial economies can be effected in fluidized-bed operation. The size of the ductwork and other transport means for conducting the particulates around the system can be reduced because the fluidizing separator 30 removes all but the char from the particulates to be transported. This is particularly advantageous in the industrial units exemplified in FIG. 3, because a given particle can be entrained and returned to the furnace a large number of times before it is finally drained off. The use of the fluidizing separator allows only the char particles, and not the inerts, to travel the loop more than once. The size of the required separator assembly 26 is thereby also reduced.

In units that include a carbon burnup cell, the present invention has the additional advantage that inerts are not required to be handled in the burnup cell, so it will be easier to maintain the high temperatures desired for effective burning of the char.

Though the invention has been described in terms of preferred embodiments, many alterations and modifications will be apparent to those skilled in the art in light of the foregoing disclosure. Accordingly, the appended claims are meant to include all such alterations and modifications as fall within their scope.

What is claimed is:

1. A fluidized-bed furnace system, comprising:

a. a fluidized-bed furnace in which carbonaceous fuel particles are burned in the presence of inert particles, gaseous combustion products thereby being produced, which combustion products entrain particulates including inert particles and char particles;

b. means for removing the particulates from the gaseous combustion products;

c. conduit means connected to the furnace and the removal means to conduct the gaseous combustion products from the furnace to the removal means;

d. means for receiving the particulates removed by the removal means and separating them into portions of relatively high and low densities, whereby the char particles are concentrated in the portion of relatively low density and the inert particles are concentrated in the portion of relatively high density;

e. a char-burning furnace, connected to the separating means to receive the portion of relatively low density, for burning the low-density portion of the particulates; and f. conduit means connected to the separating means for removing the portion of relatively high density from the fluidized-bed furnace system.

2. An apparatus as recited in claim 1, wherein the separating means comprises:

a. a perforated table having first and second ends;

b. means for conducting the particulates from the removal means and depositing them on the perforated table at its first end, thereby allowing them to migrate towards the second end;

c. means for causing a stream of air to flow up through the perforated table, the stream being sufficiently strong above the first end to fluidize substantially all the particulates occupying the table at the first end, the strength being gradually reduced towards the second end so that substantially all particulates above a predetermined density are no longer fluidized at the second end, the particulates thereby being stratified during migration from the first end to the second end so that denser particulates at the second end lie on the table below less dense particulates;

d. a scoop positioned at the second end of the table at such a height as to remove only those particulates that are more than a predetermined height above the table at the second end; and e. means for conducting from the scoop into the char-burning furnace the particulates removed by the scoop.

3. An apparatus as recited in claim 2, wherein the table comprises an endless perforated belt and the separating means further comprises means for driving the endless belt from the first end of the table to the second end of the table.

4. An apparatus as recited in claim 3, wherein the endless belt is inclined so that the second end of the table is lower than the first end of the table, migration of the particulates thereby being facilitated.

5. An apparatus as recited in claim 4, wherein the char-burning furnace is the fluidized-bed furnace.

6. An apparatus as recited in claim 3, wherein the char-burning furnace is the fluidized-bed furnace.

7. An apparatus as recited in claim 2, wherein the table is inclined so that its second end is lower than its first end, migration of the particulates thereby being facilitated.

8. An apparatus as recited in claim 7, wherein the char-burning furnace is the fluidized-bed furnace.

9. An apparatus as recited in claim 1, wherein the char-burning furnace is the fluidized-bed furnace.

10. A method of operating a fluidized-bed furnace system, comprising the steps of:

a. injecting carbonaceous fuel particles and inert particles into the furnace;

b. fluidizing the particles, thereby causing a fluidized mixture of carbonaceous fuel and inert to occupy the furnace;

c. burning the fluidized mixture, thereby producing combustion-product gases having particulates entrained therein, the particulates including char particles and inert particles;

d. removing the particulates from the combustion-product gases;

e. separating the removed particulates into portions of relatively high and relatively low densities, the low-density portion thereby having a higher char concentration than the high-density portion and the high-density portion thereby having a higher inerts concentration than the low-density portion, f. burning the low density portion; and g. removing the high-density portion from the fluidized-bed furnace system.

11. A method as recited in claim 10, wherein the separation step comprises the steps of:

a. depositing the removed particulates on the first end of a perforated table having first and second ends and allowing them to migrate to the second end;

b. blowing a stream of air up through the perforated table, the stream being strong enough above the first end to fluidize substantially all of the particulates occupying the first end, the strength being gradually reduced toward the second end so that essentially all particulates above a predetermined density are no longer fluidized at the second end, the particulates thereby being stratified during migration from the first end to the second end so that denser particles at the second end lie on the table below less dense particles; and c. scooping up the particles at the second end that are more than a predetermined height above the table, thereby separating the particulates into a low-density portion and a high-density portion.

12. A method as recited in claim 11, wherein the step of burning the low-density portion comprises the step of feeding the low-density portion into the fluidized-bed furnace in which the step of burning the fluidized mixture is taking place, the low-density portion thereby being burned with the fluidized mixture.

13. A method as recited in claim 10, wherein the step of burning the low-density portion comprises the step of feeding the low-density portion into the fluidized-bed furnace in which the step of burning the fluidized mixture is taking place, the low-density portion thereby being burned with the fluidized mixture.

14. A fluidized-bed furnace system, comprising:

a. a fluidized-bed furnace including a bed region;

b. means for supplying a mixture of carbonaceous fuel and inerts to the bed region;

c. means connected to the furnace for withdrawing part of the contents of the bed region;

d. means for receiving said part of the contents of the bed region withdrawn by the withdrawal means and separating it into portions of relatively high and low densities, whereby the char particles are concentrated in the portion of relatively low density and the inert particles are concentrated in the portion of relatively high density;

e. a char-burning furnace, connected to the separating means to receive the portion of relatively low density, for burning the low-density portion; and f. conduit means connected to the separating means for removing the portion of relatively high density from the fluidized-bed furnace system.

15. An apparatus as recited in claim 14, wherein the separating means comprises:

a. a perforated table having first and second ends;

b. means for conducting particulates from the withdrawal means, depositing them on the perforated table at the first end, and allowing them to migrate toward the second end;

c. means for causing a stream of air to flow up through the perforated table, the stream being sufficiently strong above the first end to fluidize substantially all the particulates occupying the table at the first end, the strength being gradually reduced toward the second end so that substantially all particulates above a predetermined density are no longer fluidized at the second end, the particulates thereby being stratified during migration from the first end to the second end so that denser particulates at the second end lie on the table below less dense particulates;

d. a scoop positioned at the second end of the table at such a height as to remove only those particulates that are more than a predetermined height above the table at the second end; and e. means for feeding the particulates removed by the scoop into the char-burning furnace.

16. An apparatus as recited in claim 15, wherein the table comprises an endless perforated belt and the separating means further comprises means for driving the endless belt from the first end to the second end.

17. An apparatus as recited in claim 16, wherein the endless belt is inclined so that its second end is lower than its first end, migration of the particulates thereby being facilitated.

18. An apparatus as recited in claim 17, wherein the char-burning furnace is the fluidized-bed furnace.

19. An apparatus as recited in claim 16, wherein the char-burning furnace is the fluidized-bed furnace.

20. An apparatus as recited in claim 15, wherein the perforated table is inclined so that its second end is lower than its first end, migration of the particulates thereby being facilitated.

21. An apparatus as recited in claim 20, wherein the char-burning furnace is the fluidized-bed furnace.

22. An apparatus as recited in claim 14, wherein the char-burning furnace is the fluidized-bed furnace.

23. A method of operating a fluidized-bed furnace system that includes a fluidized-bed furnace having a bed region, comprising the steps of:

a. injecting carbonaceous fuel particles and inert particles into the bed region;

b. fluidizing the particles, thereby causing a fluidized mixture of carbonaceous fuel and inerts to occupy the bed region;

c. causing combustion to occur at the bed region;

d. removing part of the mixture from the bed, the removed part thereby containing particles of relatively high and relatively low densities;

e. separating the removed part into portions of relatively high and relatively low densities, the low-density portion thereby having a higher carbonaceous fuel concentration than the high-density portion and the high-density portion thereby having a higher inerts concentration than the low-density portion, f. burning the low-density portion; and g. removing the high-density portion from the fluidized-bed furnace system.

24. A method as recited in claim 23, wherein the separation step comprises the steps of:

a. depositing the removed part of the mixture on the first end of a perforated table having first and second ends and allowing the removed part to migrate to the second end;

b. blowing a stream of air up through the perforated table, the stream being strong enough above the first end to fluidize substantially all of the particulates occupying the first end, the strength being gradually reduced toward the second end so that substantially all of the particles above a predetermined density are no longer fluidized at the second end, the particles thereby being stratified during migration from the first end to the second end so that the denser particles at the second end lie on the table below the less dense particles; and c. scooping up the particles at the second end that are more than a predetermined height above the table, thereby separating the removed part of the mixture into low-density and high-density portions.

25. A method as recited in claim 24, wherein the step of burning the low-density portion comprises feeding the low-density portion into the fluidized-bed furnace in which the combustion step is taking place, the low-density portion thereby being burned with the fluidized mixture.

26. A method as recited in claim 23, wherein the step of burning the low-density portion comprises feeding the low-density portion into the fluidized-bed furnace in which the step of burning the fluidized mixture is taking place, the low-density portion thereby being burned with the fluidized mixture.

* * * * *

UNITED STATES PATENT OFFICE

CERTIFICATE OF CORRECTION

Patent No. 4,150,632 Dated April 24, 1979

Inventor(s) Francis T. Matthews

It is certified that error appears in the above-identified patent and that said Letters Patent are hereby corrected as shown below:

Column 1, insert as the first paragraph following the heading "BACKGROUND OF THE INVENTION" the sentence --The Government of the United States of America has rights in this invention pursuant to Contract No. EX-76-C-01-2473 awarded by the U.S. Energy Research and Development Administration.--.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*